US011084561B2

(12) United States Patent
Jenkins

(10) Patent No.: US 11,084,561 B2
(45) Date of Patent: Aug. 10, 2021

(54) SQUARE-RIG WING SAIL FOR UNMANNED SURFACE VEHICLES

(71) Applicant: Saildrone, inc., Alameda, CA (US)

(72) Inventor: Richard Elliott Jenkins, Alameda, CA (US)

(73) Assignee: Saildrone, inc., Alameda, CA (US)

( * ) Notice: Subject to any disclaimer, the term of this patent is extended or adjusted under 35 U.S.C. 154(b) by 65 days.

(21) Appl. No.: 16/266,117

(22) Filed: Feb. 4, 2019

(65) Prior Publication Data

US 2020/0247515 A1 Aug. 6, 2020

(51) Int. Cl.

| | |
|---|---|
| ***B63H 9/06*** | (2020.01) |
| ***B63H 9/069*** | (2020.01) |
| ***B63H 9/067*** | (2020.01) |
| *B63B 35/00* | (2020.01) |
| *B63H 8/10* | (2020.01) |

(52) U.S. Cl.

CPC ..... *B63H 9/069* (2020.02); *B63H 9/067* (2020.02); *B63B 2035/007* (2013.01); *B63B 2203/00* (2013.01); *B63B 2209/18* (2013.01); *B63B 2211/02* (2013.01); *B63B 2213/02* (2013.01); *B63H 8/10* (2020.02)

(58) Field of Classification Search

CPC ..... B63B 2035/006; B63B 2035/007; B63B 2035/008; B63B 2035/009; B63B 2015/0016; B63B 2015/0041; B63B 2015/005; B63H 9/00; B63H 9/06; B63H 9/061; B63H 9/0615; B63H 9/0621; B63H 9/0628; B63H 9/0635; B63H 9/068

See application file for complete search history.

(56) References Cited

U.S. PATENT DOCUMENTS

| | | | | |
|---|---|---|---|---|
| 2014/0261126 | A1* | 9/2014 | Jenkins | B63B 1/12 114/39.23 |
| 2018/0072394 | A1* | 3/2018 | Bermudez Miquel | B63H 9/06 |
| 2019/0233056 | A1* | 8/2019 | Dane | B63H 9/061 |

* cited by examiner

*Primary Examiner* — Andrew Polay
(74) *Attorney, Agent, or Firm* — Wei & Sleman LLP

(57) ABSTRACT

Techniques are provided for an unmanned surface vehicle including a vehicle body and a rigid square-rig wing coupled with the primary vehicle body. The rigid square-rig wing includes a first surface configured to interact with wind to generate a force that propels the primary vehicle body in a direction of travel that is primarily composed of drag, and a second surface configured to interact with the wind to generate a force that propels the primary vehicle body in a direction of travel that is primarily composed of lift. The unmanned surface vehicle further includes a rudder and a control system comprising a controller, the control system configured to determine a rudder position and generate a signal to position the rudder to the rudder position.

18 Claims, 6 Drawing Sheets

SQUARE-RIG WING SAIL FOR UNMANNED SURFACE VEHICLES

FIELD OF THE DISCLOSURE

The present disclosure generally relates to autonomous vehicles, and relates more specifically to a square-rig wing sail for unmanned surface vehicles.

BACKGROUND

The approaches described in this section are approaches that could be pursued, but not necessarily approaches that have been previously conceived or pursued. Therefore, unless otherwise indicated, it should not be assumed that any of the approaches described in this section qualify as prior art merely by virtue of their inclusion in this section.

The Southern Ocean includes the southernmost waters of the Earth surrounding Antarctica, generally starting south of Australia. The Southern Ocean is known for its turbulent conditions, with the strongest average winds found anywhere on Earth occurring between 40° south to the Antarctic Circle. Winds can average 40-60 knots in winter. The temperature also falls below freezing for prolonged periods, with sea ice extending as far north as 55° south. Southern Ocean storms are fast moving and frequent. The lack of continental land mass in the Southern Ocean can also magnify some of these effects. The open expanse and allows for sustained forces that are ideal for that large wave formation.

The Southern Ocean is also ecologically and environmentally important. For example, the Antarctic Convergence is a varying curve that encircles Antarctica where north-flowing Antarctic water meets the warmer subantarctic waters. The Antarctic Convergence is a natural definition of the northern boundary of the Southern Ocean. At this boundary, the Antarctic water sinks, causing mixing and upwelling. The action forms a nutrient-rich zone that is important to marine life, such as seabirds and marine mammals. For example, such water movement carries Antarctic krill, a staple that many oceanic life forms depend on, which thrives in cold Antarctic waters. Cold currents moving further northward also bring nutrient-rich waters throughout the world.

Climate change may also interact strongly with the Southern Ocean. For example, Antarctic krill stocks have dropped by up to 80 percent since the 1970s, in part due to ice loss and a corresponding decrease in ice-algae on which the Antarctic krill feeds. The Southern Ocean is also believed to act as a carbon sink, and its ability to hold carbon dioxide may be affected by the warming climate. It is believed that the waters of the Southern Ocean are warming, desalinating, and acidifying.

Although it is desirable to monitor the Southern Ocean for multiple reasons, the area is difficult to monitor. In addition to being remote from populated areas, the rough conditions limit the ability to travel to, operate in, or deploy equipment in the Southern Ocean. For example, ships generally limit travel in the Southern Ocean during winter due to the hazardous conditions. Thus, despite its importance, scientists know the least about the Southern Ocean out of the world's oceans.

SUMMARY

The appended claims may serve as a summary of the invention.

Figure 1:
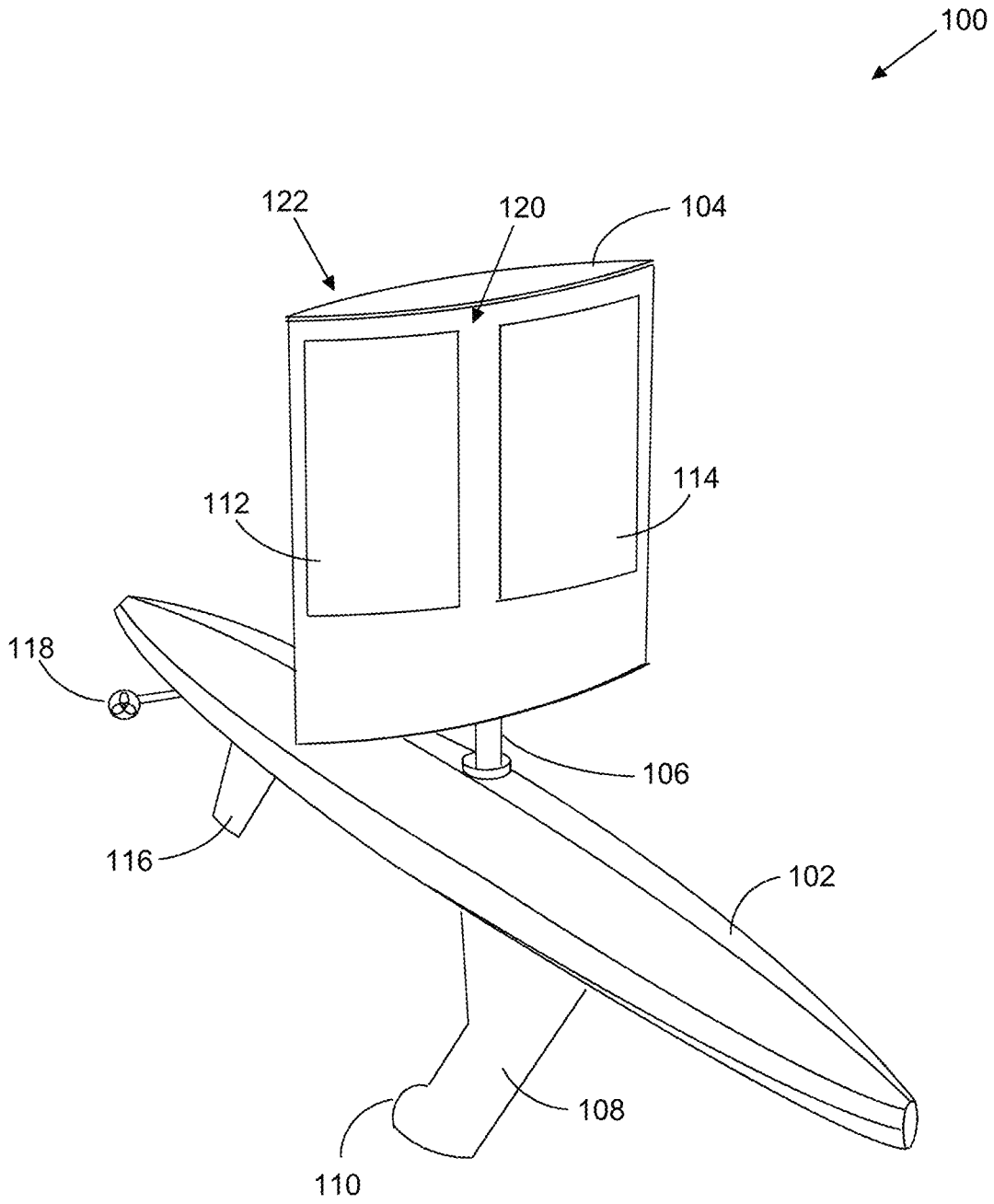
FIG. 1 illustrates an unmanned surface vehicle with a square-rig wing sail in an example embodiment.

While each of the drawing figures illustrates a particular embodiment for purposes of illustrating a clear example, other embodiments may omit, add to, reorder, or modify any of the elements shown in the drawing figures. For purposes of illustrating clear examples, one or more figures may be described with reference to one or more other figures, but using the particular arrangement illustrated in the one or more other figures is not required in other embodiments.

DETAILED DESCRIPTION

In the following description, numerous specific details are set forth in order to provide a more thorough understanding of embodiments of the invention. It will be apparent, however, to a person of ordinary skill that the present invention may be practiced without incorporating all aspects of the specific details described herein. In other instances, specific features, quantities, or measurements well known to those of ordinary skill in the art have not been described in detail so as not to obscure the invention. Readers should note that although examples of the invention are set forth herein, the claims, and the full scope of any equivalents, are what define the metes and bounds of the invention. Furthermore, a person of ordinary skill in the art will recognize that methods and processes described herein may be performed in a different order, in series, in parallel, and/or in a multi-threaded environment without departing from the spirit or the scope of the invention.

It will be further understood that: the term "or" may be inclusive or exclusive unless expressly stated otherwise; the term "set" may comprise zero, one, or two or more elements; the terms "first", "second", "certain", and "particular" are used as naming conventions to distinguish elements from each other does not imply an ordering, timing, or any other characteristic of the referenced items unless otherwise specified; the term "and/or" as used herein refers to and encompasses any and all possible combinations of one or more of the associated listed items; that the terms "comprises" and/or "comprising" specify the presence of stated features, but do not preclude the presence or addition of one or more other features.

General Overview

This document generally describes systems, methods, devices, and other techniques for a square-rig wing sail for unmanned surface vehicles. An unmanned surface vehicle sails using a square-rig wing. The square-rig wing has a first surface that interacts with the wind to generate thrust primarily composed of drag, and a second surface that interacts with the wind to generate thrust primarily composed of lift. The first surface may face a rear of the unmanned surface vehicle, and the second surface may face a front of the unmanned surface vehicle. When the unmanned surface vehicle travels directly downwind, the aerodynamic force created is primarily drag due to the wind interacting with the first surface of the square-rig wing. The unmanned surface vehicle also has a rudder and a controller that positions the rudder to achieve a desired direction of travel. In some embodiments, while the square-rig wing is less efficient at travelling in a full range of directions than a standard wing sail that minimizes drag, the benefits of the square-rig wing make it suitable for specific conditions.

In traditional ocean travel, a square rig refers to a traditional cloth-sail and rigging arrangement in which the primary driving sails are carried on perpendicular spars that are perpendicular to, or squared to, the keel and mast. The traditional square rig was efficient for sailing downwind due to its use of drag. As used herein, the term "square-rig" refers to the drag-efficient properties of the traditional square rig sailing and rigging techniques, but does not require any properties of the traditional square rig sailing and rigging techniques other than those described with respect to in one or more embodiments. Furthermore, the term "square rig" does not refer to any particular geometry (e.g. a square, as a geometric planar figure with four equal straight sides and four right angles).

In some implementations, the various techniques described herein may achieve one or more of the advantages described hereinafter. A square-rig wing as described herein can handle rougher conditions. For example, in an embodiment where the square-rig wing is fixedly attached to a vehicle body, the only moving part in the system is the rudder. Furthermore, in a fixed wing embodiment, a mast of the unmanned surface vehicle can be reinforced without affecting rotational movement. The square-rig wing may also handle stronger wind conditions. For example, in general, a square-rig-rigged sail is less prone to broaching (e.g. a sudden change in heading towards the wind for which the rudder cannot compensate). An unmanned surface vehicle with a square-rig wing may be deployed into extreme conditions, such as but not limited to the Southern Ocean, storm conditions, and the like.

Additional features and advantages are apparent from the specification and the drawings.

Unmanned Surface Vehicle Overview

FIG. 1 illustrates an unmanned surface vehicle with a square-rig wing sail in an example embodiment. The unmanned surface vehicle 100 includes a vehicle body 102. The vehicle body 102 has a primary axis that runs from a front end of the vehicle body 102 to a rear end of the vehicle body 102. The vehicle body 102 may include one or more buoyant compartments. In some embodiments, the vehicle body 102 has a narrow front end with reduced buoyancy, allowing the vehicle body 102 to break through at least a top portion of a wave due to the properties of the front end.

The unmanned surface vehicle 100 further includes a square-rig wing 104. The square-rig wing 104 may be rigid. For example, the square-rig wing 104 may be made of wood, metal, plastic, fiberglass, a carbon fiber, resin, another composite material, and/or any other rigid material. In some embodiments, the square-rig wing 104 may include one or more flexible components. For example, a square-rig wing 104 may include a flexible material stretched over rigid spars. The square-rig wing 104 is coupled with the vehicle body 102. In some embodiments, the square-rig wing 104 is coupled to a mast 106 that is coupled to the vehicle body 102 as an end of the mast 106. The square-rig wing 104 may be removably coupled with the vehicle body 102, such as to facilitate transportation, repair, storage, or any other function. Square-rig wings are described in greater detail hereinafter.

In some embodiments, the unmanned surface vehicle 100 further includes a keel 108. The keel 108 is coupled with the vehicle body 102 at a first end of the keel 108. In some embodiments, the keel 108 is removably coupled with the vehicle body 102, such as to facilitate transportation, repair, storage, or any other function. As shown, one keel 108 is coupled to the vehicle body 102, but one or more keels 108 may be coupled with any underwater surface of unmanned surface vehicle 100 without departing from the spirit or the scope of the invention.

In some embodiments, the keel 108 includes sufficient ballast to provide a positive righting moment when the vehicle body 108 is rotated to any angle about its primary axis. In particular, the keel 108 includes sufficient ballast to passively right the unmanned surface vehicle 100 from any position, including any position outside of normal operating range. Suitable ballast may include lead, concrete, iron or any other high-density material suitable for use as ballast. As used herein, the term "normal operating range" refers to any orientation of the primary vehicle body where the rigid wing is capable of generating lift and/or drag to propel the primary vehicle body.

The unmanned surface vehicle 100 further includes a rudder 116. The rudder 116 is configured to control a direction of movement of the unmanned surface vehicle 100 through the water. As shown, the rudder 116 is coupled to the vehicle body 102 at a first end of the rudder 116, but one or more rudders may be coupled with any underwater surface of the unmanned surface vehicle 100 without departing from the spirit or the scope of the invention. In some embodiments, the rudder 116 is removably coupled with the vehicle body 102, such as to facilitate transportation, repair, storage, or any other function.

The unmanned surface vehicle 100 may include a controller configured to control a rudder actuator or other rudder control to position the rudder 116. For example, the controller may determine a rudder position to achieve a desired heading, and generate a signal to position the rudder 116 based on the determined rudder position. Controllers are described in greater detail hereinafter.

In some embodiments, the square-rig wing 104 is the primary propulsion system of the unmanned surface vehicle 100. That is, the unmanned surface vehicle 100 may derive substantially all of its propulsion from wind power. Alternatively and/or in addition, the unmanned surface vehicle 100 may use another means of propulsion, such as one or more propellers. As shown, the propeller 110 is coupled to the vehicle body 102 at a second end of the keel 108, but one or more propellers may be coupled with any underwater surface of the unmanned surface vehicle 100 without departing from the spirit or the scope of the invention. In some embodiments, the propeller 110 is used in a low-wind situation to generate propulsion, such as when the wind is still. Alternatively and/or in addition, in some embodiments, the propeller 110 is used to assist directional control in a high-wind situation or to otherwise generate propulsion forces that modify the aerodynamic forces generated by wind interacting with the square-rig wing 104.

The unmanned surface vehicle 100 may include one or more additional power sources to operate components of the unmanned surface vehicle 100, such as but not limited to one or more propellers 110. For example, such additional power sources may include solar panels 112-114, a water generator 118, and/or another power source. As shown, the solar panels 112-114 are disposed on a surface of the square-rig wing 104, but one or more solar panels may be disposed on any surface of the unmanned surface vehicle 100 without departing from the spirit or the scope of the invention. For example, one or more solar panels 112-114 may be disposed on one or more above-water surfaces of the vehicle body 102 and/or the square-rig wing 104.

In some embodiments, the unmanned surface vehicle 100 includes a water generator 118, such as a turbine system that generates power when moved through the water. As shown, the water generator 118 is coupled to the bottom of the vehicle body 102, but one or more water generators may be coupled with any underwater surface of the unmanned surface vehicle 100 without departing from the spirit or the scope of the invention. The water generator 118 may generate power to operate components of the unmanned surface vehicle 100 in low-light situations, such as during inclement weather or during winter at high latitudes.

Square-Rig Wing Sail

The square-rig wing 104 may have a first surface 122 and a second surface 120. When the first surface 122 and the second surface 120 of the square-rig wing 104 interact with the wind, aerodynamic forces are generated, such as lift and drag. A resulting force, referred to herein as thrust, propels the unmanned surface vehicle 100 through the water in the direction of movement of the unmanned surface vehicle 100. The first surface 122 interacts with the wind to generate thrust primarily composed of drag, or a force that is parallel to the wind. In some embodiments, the first surface 122 faces a rear end of the vehicle body 102. The second surface 120 interacts with the wind to generate thrust primarily composed of lift, or a force that is perpendicular to the wind.

As used herein, the term "primarily" refers to a majority, such as greater than about 50%, greater than about 60%, greater than about 70%, or the like. In some embodiments, the first surface 122 and the second surface 120 are each capable of generating lift and drag that contribute to thrust in some embodiments, even when a primary component of the thrust is drag for the first surface 122, and when a primary component of the thrust is lift for the second surface 120. When the unmanned surface vehicle travels 100 directly downwind, the aerodynamic force propelling the unmanned surface vehicle in a direction of travel of the unmanned surface vehicle is primarily composed of drag due to the wind interacting with the first surface 122 of the square-rig wing 104.

In some embodiments, the second surface 120 faces a front end of the vehicle body 102. As shown, the square-rig wing 104 has a rectangular shape when viewed from the front of the unmanned surface vehicle 100. However, a square-rig wing may have another shape while maintaining the properties described herein without departing from the spirit or the scope of the invention.

In some embodiments, the square-rig wing 104 is fixedly coupled with the vehicle body 102. For example, the square-rig wing 104 may be fixedly coupled with the vehicle body 102 such that a length of the square-rig wing 104 is about perpendicular to the primary axis of the vehicle body 102. The square-rig wing 104 may be substantially symmetrical with respect to the sailing direction to provide substantially similar performance sailing on the left or the right of the wind. In some embodiments, when the square-rig wing 104 is fixedly coupled with the vehicle body 102, the unmanned surface vehicle 100 may travel in a wide arc (such as about 220°) with respect to the wind. The aerodynamic properties of a fixedly coupled square-rig wing 104 in an embodiment are described in greater detail hereinafter.

In some embodiments, the square-rig wing 104 is rotationally coupled with the vehicle body 102 such that the square-rig wing 104 is rotatable about a rotational axis. For example, the square-rig wing 104 may be coupled with a mast 106 that is rotationally coupled with the vehicle body 102 such that the square-rig wing 104 is rotatable about the mast 106. The rotational axis of square-rig wing 104 may be selected to statically balance the square-rig wing 104 with respect its rotational axis. When the square-rig wing 104 is rotationally coupled with the vehicle body 102, the unmanned surface vehicle 100 may travel in range of directions that is substantially greater than a fixed-wing embodiment; that is, a rotationally-coupled square-rig wing 104 enables the unmanned surface vehicle 100 to travel upwind. The aerodynamic properties of a rotationally coupled square-rig wing 104 in an embodiment is described in greater detail hereinafter.

In some embodiments, the square-rig wing 104 includes one or more buoyant compartments within a body of the square-rig wing 104. Buoyant compartments, such as sealed dry compartments, may provide positive righting moment depending on the orientation of the vehicle relative to the buoyant compartment. As used herein, the term "positive righting moment" refers to any torque tending to restore a vehicle to an upright position.

Figure 2A:
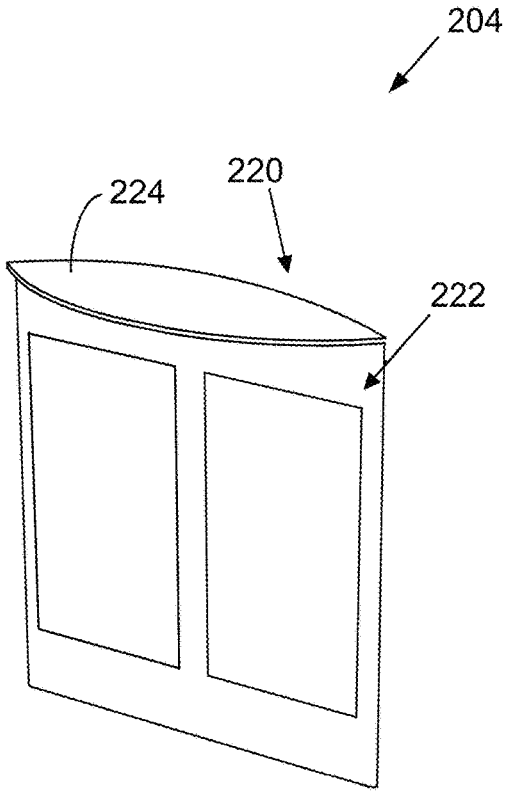
FIG. 2A illustrates a flat square-rig wing sail in an example embodiment.

As shown in FIG. 1, the first surface 122 and the second surface 120 are convex with respect to a plane through the square-rig wing 104 between the first surface 122 and the second surface 120. In some embodiments, the first surface may have a different shape. For example, FIG. 2A illustrates a flat square-rig wing sail in an example embodiment. The square-rig wing 204 has a first surface 222 that is flat with respect to a plane through the square-rig wing 204 between the first surface 222 and the second surface 220. When the first surface 222 is flat, the amount of drag generated when the wind interacts with the first surface 222 may be increased, such as when the wind approaches the first surface 222 at a perpendicular angle. In some embodiments, the square-rig wing 204 may have a lip 224 at the top of the second surface 220 that discourages the flow of air over the top of the square-rig wing 204 and/or minimizes vortices as wind travels over the top of the square-rig wing 204.

Figure 2B:
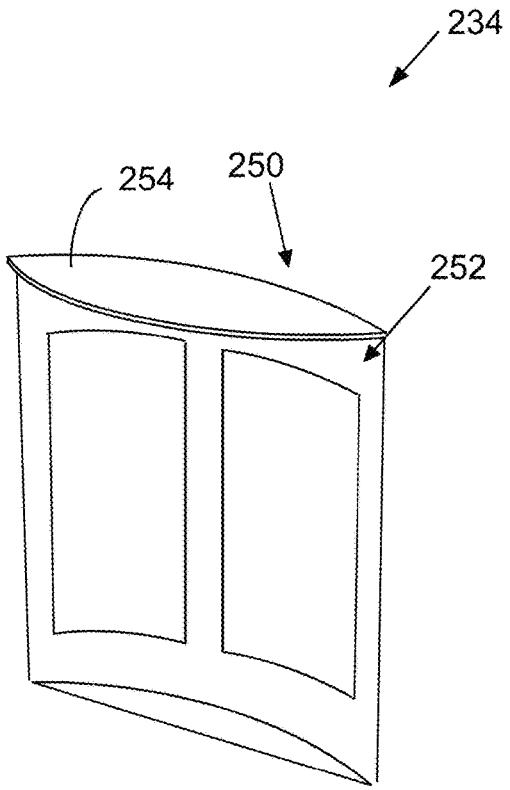
FIG. 2B illustrates a concave square-rig wing sail in an example embodiment.

As another example, FIG. 2B illustrates a concave square-rig wing sail in an example embodiment. The square-rig wing 234 has a first surface 252 that is concave with respect to a plane through the square-rig wing 234 between the first surface 252 and the second surface 250. When the first surface 252 is concave, the amount of drag generated when the wind interacts with the first surface 252 may be increased, such as when the wind approaches the first surface 252 at a perpendicular angle. In some embodiments, the square-rig wing 234 may have a lip 254 at the top of the second surface 250 that discourages the flow of air over the top of the square-rig wing 234 and/or minimizes vortices as wind travels over the top of the square-rig wing 234.

Aerodynamic Forces

Aerodynamic forces are generated when wind interacts with the square-rig wing 104. The aerodynamic forces involved depend on wind speed and direction as well as the speed and direction the unmanned surface vehicle 100 is moving. The "true wind" refers to the wind speed and direction over a stationary surface, while the "apparent wind" refers to the wind speed and direction relative to the unmanned surface vehicle 100.

The apparent wind on the square-rig wing 104 creates a total aerodynamic force, which may be resolved into drag and lift. Drag refers to the force component in the direction of the apparent wind. Lift refers to the force component normal (90°) to the apparent wind. Depending on the alignment of the apparent wind on the square-rig wing sail 104, lift or drag may be the predominant aerodynamic force propelling the vehicle body 102 of the unmanned surface vehicle 100 through the water.

Figure 3A:
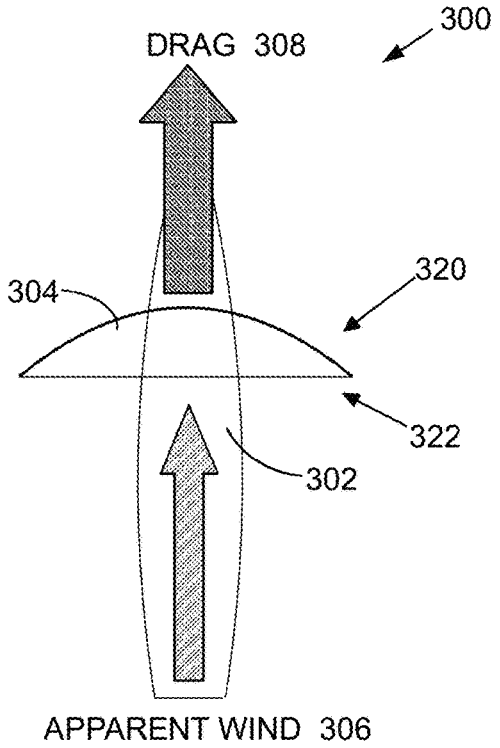
FIG. 3A illustrates forces acting on an unmanned surface vehicle with a fixed square-rig wing sail travelling downwind in an example embodiment.

FIG. 3A illustrates forces acting on an unmanned surface vehicle with a fixed square-rig wing sail travelling downwind in an example embodiment. The rudder of the unmanned surface vehicle 300 is positioned to direct the unmanned surface vehicle 300 downwind, or approximately in the direction the vehicle body 302 is pointed. In this position relative to the apparent wind 306, the force generated on the square-rig wing 304 is primarily a drag component 308. The drag component 308 is generated by the interaction of the apparent wind 306 with the first surface 322 of the square-rig wing 304, while little or no substantial lift is generated as there is no substantial interaction between the apparent wind 306 and the second surface 320.

Figure 3B:
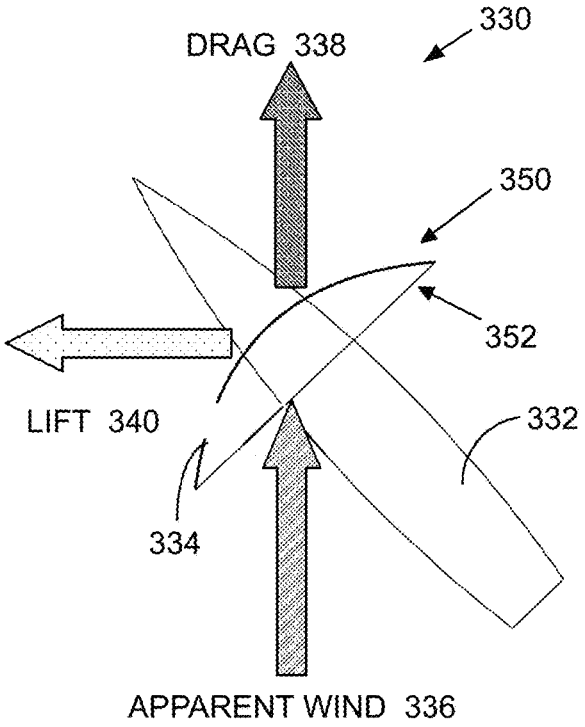
FIG. 3B illustrates forces acting on an unmanned surface vehicle with a fixed square-rig wing sail travelling at an intermediate angle with respect to apparent wind in an example embodiment.

FIG. 3B illustrates forces acting on an unmanned surface vehicle with a fixed square-rig wing sail travelling at an intermediate angle with respect to apparent wind in an example embodiment. The rudder of the unmanned surface vehicle 330 is positioned to direct the unmanned surface vehicle 330 at the intermediate angle relative to the apparent wind 336, or approximately in the direction the vehicle body 332 is pointed. In this position relative to the apparent wind 336, the force generated on the square-rig wing 334 includes both a drag component 338 and a lift component 340. The drag component 338 is generated by the interaction of the apparent wind 336 with the first surface 352 of the square-rig wing 334. The lift component 340 is generated by the interaction of the apparent wind 336 with the second surface 350 of the square-rig wing 334.

Figure 3C:
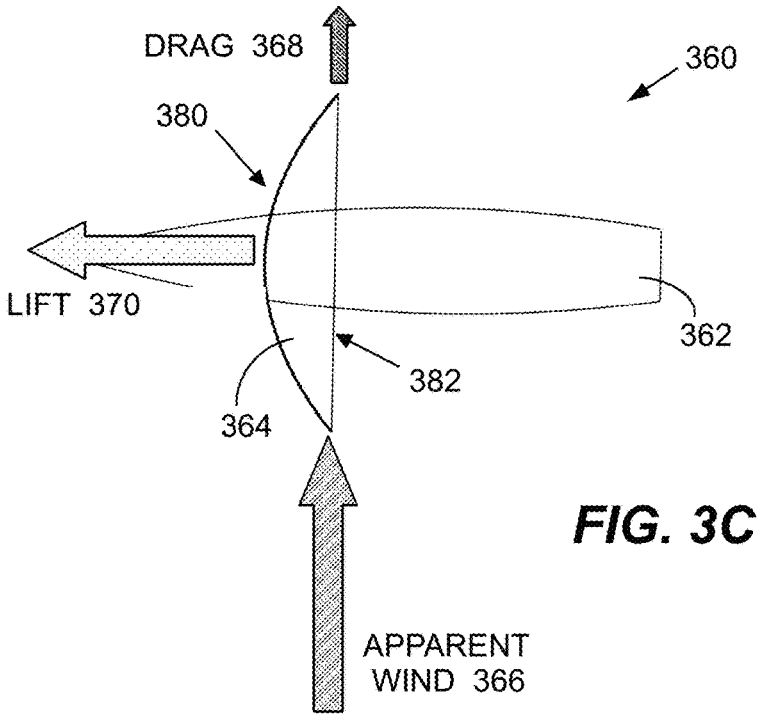
FIG. 3C illustrates forces acting on an unmanned surface vehicle with a fixed square-rig wing sail travelling perpendicular with respect to apparent wind in an example embodiment.

FIG. 3C illustrates forces acting on an unmanned surface vehicle with a fixed square-rig wing sail travelling perpendicular with respect to apparent wind in an example embodiment. The rudder of the unmanned surface vehicle 360 is positioned to direct the unmanned surface vehicle 360 in a perpendicular direction relative to the apparent wind 366, or approximately in the direction the vehicle body 362 is pointed. In this position relative to the apparent wind 366, the force generated on the square-rig wing 364 is primarily a lift component 370. The lift component 370 is generated by the interaction of the apparent wind 366 with the second surface 380 of the square-rig wing 364, while little or no substantial drag component 368 is generated based on the interaction between the apparent wind 366 and the first surface 382.

When the square-rig wing 364 is fixedly coupled with the vehicle body 362, the unmanned surface vehicle 360 may travel about perpendicular to the wind. For example, the rudder may be positioned to point the vehicle body 362 to sail up about perpendicular to the left of the apparent wind, or the rudder may be positioned to point the vehicle body 362 to sail up about perpendicular to the right of the apparent wind.

Rotating Square-Rig Wing

Figure 4:
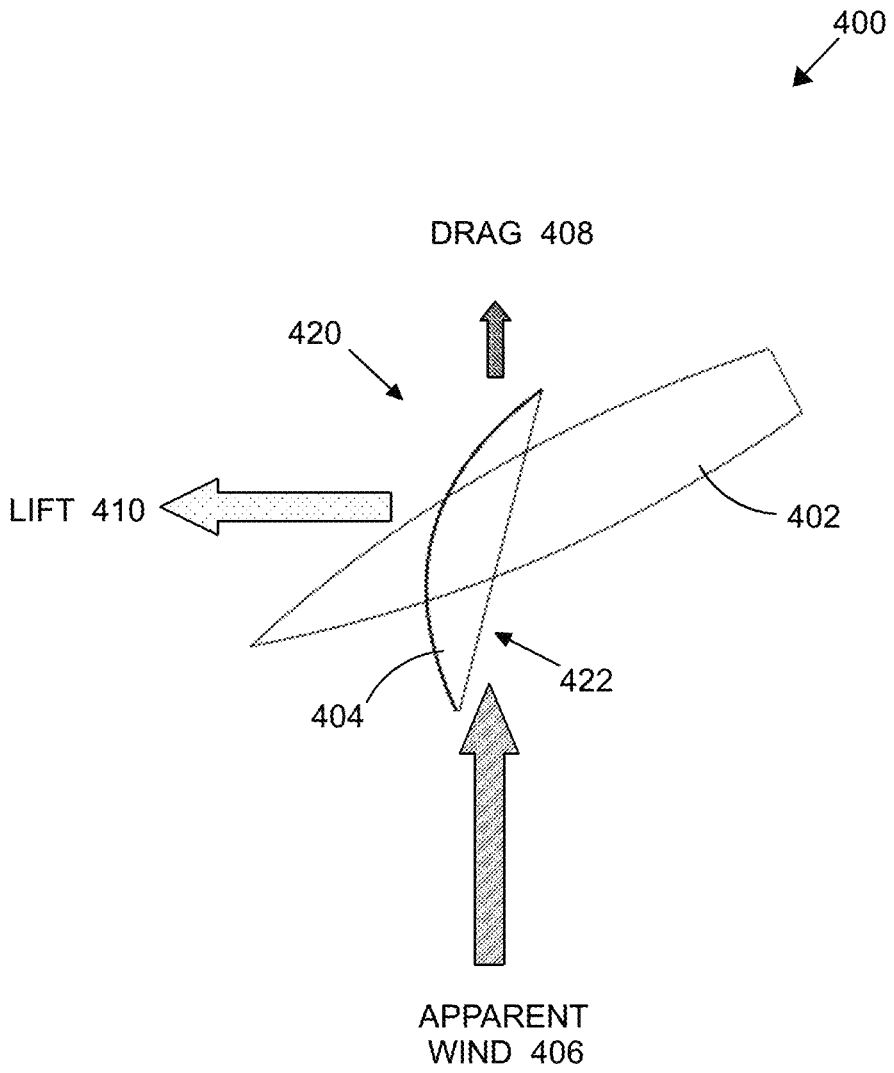
FIG. 4 illustrates forces acting on an unmanned surface vehicle with a rotating square-rig wing sail in an example embodiment.

FIG. 4 illustrates forces acting on an unmanned surface vehicle with a rotating square-rig wing sail in an example embodiment. The rudder of the unmanned surface vehicle 400 is positioned to direct the unmanned surface vehicle 400 upwind relative to the apparent wind 406, or approximately in the direction the vehicle body 402 is pointed. In this position relative to the apparent wind 406, the force generated on the square-rig wing 404 is primarily a lift component 410. The lift component 410 is generated by the interaction of the apparent wind 406 with the second surface 420 of the square-rig wing 404, while a relatively small drag component 408 is generated based on the slight interaction between the apparent wind 406 and the first surface 422.

The unmanned surface vehicle 400 may include a controller configured to control an angle of the square-rig wing 404. For example, the controller may determine a wing angle to maintain a desired heading, and generate a signal to position the square-rig wing 404 based on the determined wing angle.

The rotation of the wing allows the unmanned surface vehicle 400 to sail upwind. In some embodiments, the square-rig wing 404 has a range of about 45° in each direction, allowing the unmanned surface vehicle to sail in about a 270° range with respect to the wind. In some embodiments, the rotation of the wing allows the unmanned surface vehicle 400 to sail a substantial arc with respect to the wind, such as but not limited to a 300 degree arc with respect to the wind.

System Architecture

Figure 5:
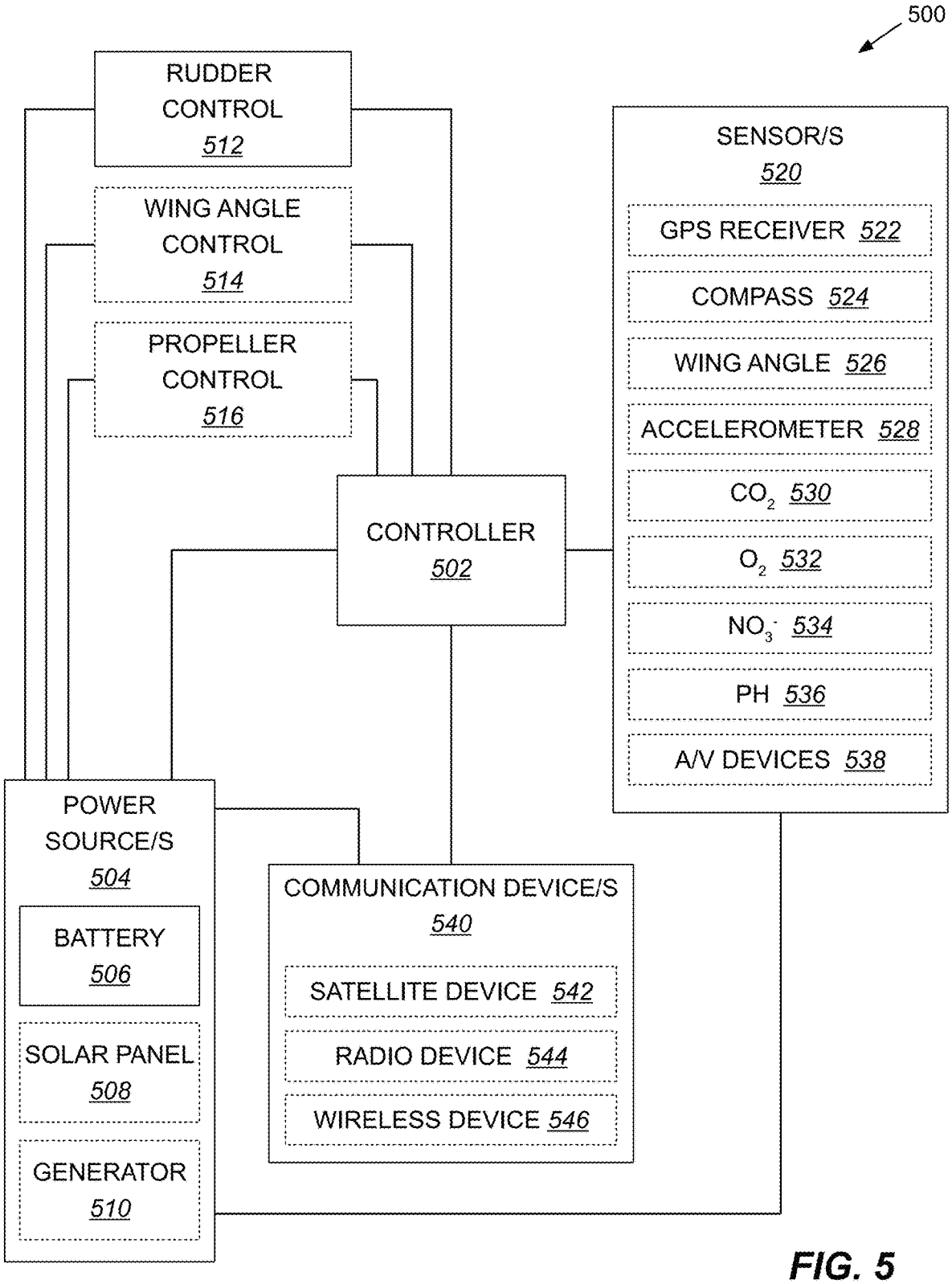
FIG. 5 illustrates a system diagram for an unmanned surface vehicle in an example embodiment.

FIG. 5 illustrates a system diagram for an unmanned surface vehicle in an example embodiment. The system 500 includes a controller 502. The controller 502 is configured to control navigation and other operation of an unmanned surface vehicle with a square-rig wing sail. In some embodiments, the controller 502 may be configured to obtain one or more waypoints and navigate an unmanned sailing vehicle to the one or more waypoints without additional communication to direct navigation. As used herein, the term "waypoint" refers to any data containing a geographic location. Additionally, controller 502 may be configured to obtain one or more paths and navigate the one or more paths without additional communication to direct navigation. In some embodiments, controller 502 is configured to obtain a heading and navigate by maintaining the heading. In some embodiments, controller 502 is configured to maintain a heading relative to the true wind direction and navigate by maintaining the relative heading.

The system includes at least one power source 504. The power source/s 504 are configured to power one or more components of the system 500, such as but not limited to the controller 502. The power source/s 504 may further be configured to power one or more mechanical components, such as the wing angle control 512, the rudder control 514, the propeller control 516, and/or other components of the system 500. In some embodiments, the power source/s are further configured to power at least one of the communication device/s 540 and/or the sensor/s 520. Alternatively and/or in addition, at least one of the sensor/s 520 and/or the communication device/s 540 may be powered by another power source.

The power source/s 504 of the system 500 may include one or more power generating components 508-510, such as one or more solar panels 508 and/or one or more generators 510. For example, a water generator may be attached to the vehicle body of an unmanned surface vehicle such that movement of the vehicle body through water generates energy. Alternatively and/or in addition, a water generator may harness wave energy. As another example, a wind generator may be used to convert wind energy into electric power.

In some embodiments, the power source/s 504 include at least one battery 506. The battery 506 may be rechargeable. The one or more power generating components 508-510 may be wired or otherwise configured to charge at least one rechargeable battery 506, where the battery 506 is configured to power one or more components of the system 500. Alternatively and/or in addition, the one or more power generating components 508-510 may be wired or otherwise configured to directly power one or more components of the system 500.

The system 500 further includes a rudder control 512. The rudder control 512 is configured to position the rudder based on a signal received from controller 502. For example, the rudder control 512 may include one or more rudder actuators that move the rudder in response to a signal from the controller 502. The rudder control 512 may include any combination of electronic and/or mechanical elements capable of positioning the control surface element, including but not limited to motors, gears, belts, rods, and any other component.

In embodiments of the unmanned surface vehicle with a rotatable square-rig wing, the system 500 may further include a wing angle control 514. The wing angle control 514 is configured to rotationally position the square-rig wing based on a signal received from controller 502. For example, the wing angle control 514 may include one or more components to rotate a mast in response to a signal from the controller 502, where the mast is fixedly coupled to the square-rig wing and rotationally coupled to the vehicle body. The wing angle control 514 may include any combination of electronic and/or mechanical elements capable of maintaining and/or changing a wing angle of the square-rig wing, including but not limited to motors, gears, belts, rods, and any other component.

In some embodiments, the system 500 further includes a propeller control 516. The propeller control 516 is configured to position and/or move one or more propellers of the unmanned surface vehicle based on a signal received from controller 502. For example, the propeller control 516 may include one or more components to drive and/or position the propeller in response to a signal from the controller 502. The propeller control 516 may include any combination of electronic and/or mechanical elements capable of positioning and/or driving the propeller/s, including but not limited to motors, gears, belts, rods, and any other component.

The system 500 further includes one or more sensors 522-538 (collectively, sensor/s 520). As used herein, the term "sensor" refers to any device capable of collecting and/or receiving data. In some embodiments, the sensor/s 520 include one or more devices capable of receiving one-way communications, such as a GPS receiver 522. The sensor/s 520 may further include a compass 524, a wing angle sensor 526, an accelerometer 528, other instruments relating to navigation, and/or other instruments relating to vehicle operation or vehicle state.

In some embodiments, the sensor/s 520 may include one or more A/V devices 538 for recording data and/or images, such as an audio recorder, a camera, another image capture device, a sonar system, a video recorder, another video capture device, any other A/V device. Such devices may capture audio and/or video data in any band, such as human-audible or non-human-audible audio bands and human-visible light bands or non-human-visible light bands.

The sensor/s 520 may also include one or more environmental sensors such as a $CO_2$ sensor 530, an $O_2$ sensor 532, a $NO_3^-$ sensor 534, a pH sensor 536, one or more other chemical sensors, a temperature sensor, a moisture sensor, a wind sensor, a precipitation sensor, or any other environmental sensor. The controller 502 may also calculate one or more environmental parameters based on one or more sensor readings. For example, the controller 502 may determine a velocity based on one or more GPS readings. As another example, the controller 502 may determine one or more environmental parameters, such as swell height, swell wavelength, current, or the like, by performing calculations based on one or more sensor readings.

One or more sensor/s 520 may be communicatively coupled with the controller 502, such as via a wire, circuit or another electronic component. The sensor/s 520 may also communicate wirelessly with the controller 502.

The system 500 may further include one or more communication devices 542-350 (collectively, communication device/s 540). As used herein, the term "communication device" refers to any device capable of transmitting data, including one-way communication devices capable of transmission only as well as devices capable of both transmitting and receiving data. For example, the communication device/s 540 may include one or more two-way communication devices, such as but not limited to a satellite device 542, a radio device 544, a wireless device 546, or any other communication device.

The communication device/s 540 may be communicatively coupled with the controller 502, such as via wiring, circuits and/or another electronic component. The communication device/s 540 may also communicate wirelessly with the controller 502, such as via the wireless device 546 or another wireless device coupled with controller 502. In some embodiments, at least one of the communication device/s 540 is configured to transmit data generated by controller 502 based on at least one of the sensor/s 520.

In some embodiments, the controller 502 is configured to obtain navigation instructions, such as one or more waypoints, locations, or other location information, from any of the communication device/s 540. The navigation instructions may include time information and/or action information. For example, the navigation instructions may indicate taking a particular sensor reading at a particular location at a particular time. The controller 502 may use one or more sensor readings and/or calculated parameters to autonomously navigate according to the navigation instructions, including but not limited to information from environmental sensors, navigation instruments, and sensors relating to vehicle operation and/or vehicle state. For example, the controller 502 may calculate a rudder position to comply with the navigation instructions, and send a signal to the rudder control 512 to position the rudder accordingly. In some embodiments, the controller 502 periodically calculates a desired heading based on sensor information from the sensor/s 520, and periodically updates the rudder position accordingly. In some embodiments, the controller 502 calculates a wing angle to comply with the navigation instructions, and sends a signal to the wing angle control 514 to position the square-rig wing accordingly. In some embodiments, the controller 502 calculates a propeller angle and/or speed to comply with the navigation instructions, and sends a signal to the propeller control 516 to operate the propeller accordingly.

Alternatively and/or in addition, the navigation instructions may include explicit instructions for controlling one or more components of the system 500 that are carried out by the controller 502. For example, if an administrator wishes to override an autonomously calculated rudder position, the administrator may send a navigation instruction with a desired rudder position that causes the controller 502 to cause the rudder control 512 to position the rudder in the desired rudder position. In some embodiments, such explicit instructions can be used to direct the controller 502 to control another component of the system 500 as specified in the explicit instructions, such as but not limited to the wing angle control 514, the propeller control 516, one or more power sources 504, one or more communication devices 540, one or more sensors 520, or any other component of the system 500.

In some embodiments, the controller 502 may further be configured to handle one or more obstacles, including weather, unauthorized areas, other vehicles, or any other obstacle or danger. The obstacles may be identified based on data collected by the one or more sensors 520 of the system 500. Alternatively, information about the obstacles may be received via one or more communication device/s 540.

In some embodiments, an unmanned surface vehicle includes one or more independent systems. For example, an independent system may be provided by a third party. An independent system may include one or more sensor/s, communication devices, power sources, and/or controllers that are separate from the system 500. Alternatively and/or in addition, an independent system may utilize one or more components of the system 500. For example, an independent system may include an independent controller that controls one or more independent sensors, but may share one or more power source/s 504 and/or one or more communications device/s 540 of the system 500.

Implementation Mechanisms-Hardware Overview

In some embodiments, one or more autonomous sailing vehicles as described herein are operated remotely. For example, a computing device may include control features for operating one or more autonomous sailing vehicles. In some embodiments, a plurality of autonomous sailing vehicles are operable in a synchronized manner. For example, a computing device may display data received from one or more communication devices 540 of the system 500, including navigation data, position data, operation data, sensor data, or any other data generated by the system 500 of the unmanned surface vehicle. In some embodiments, the computing device may generate one or more instructions that are transmitted to the system 500. When such instructions are received by the system 500, the controller 502 may process and act on the instructions.

According to one embodiment, the techniques described herein are implemented by one or more special-purpose computing devices. The special-purpose computing devices may be hard-wired to perform one or more techniques described herein, including combinations thereof. Alternatively and/or in addition, the one or more special-purpose computing devices may include digital electronic devices such as one or more application-specific integrated circuits (ASICs) or field programmable gate arrays (FPGAs) that are persistently programmed to perform the techniques. Alternatively and/or in addition, the one or more special-purpose computing devices may include one or more general purpose hardware processors programmed to perform the techniques described herein pursuant to program instructions in firmware, memory, other storage, or a combination. Such special-purpose computing devices may also combine custom hard-wired logic, ASICs, or FPGAs with custom programming to accomplish the techniques. The special-purpose computing devices may be desktop computer systems, portable computer systems, handheld devices, networking devices and/or any other device that incorporates hard-wired or program logic to implement the techniques.

Figure 6:
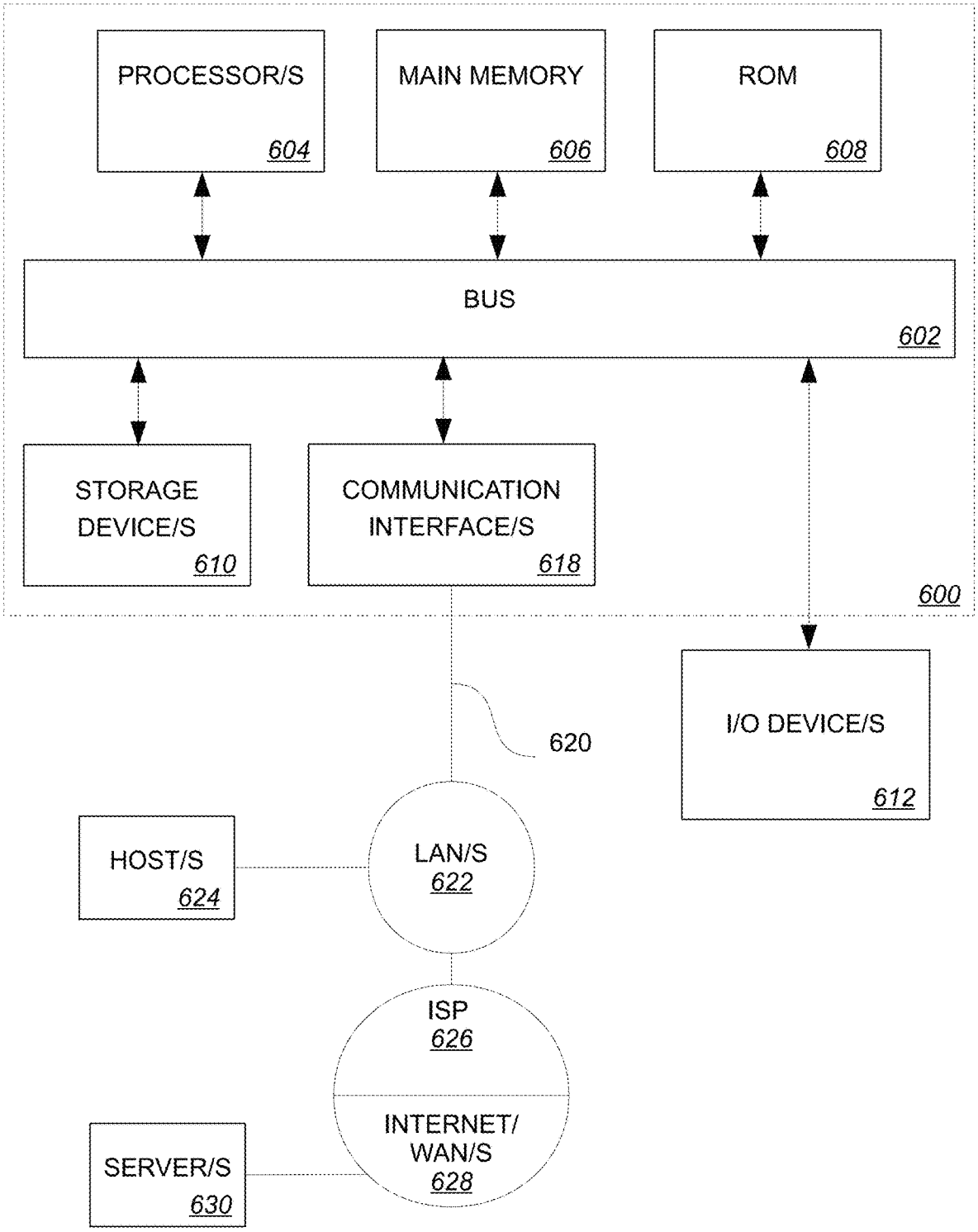
FIG. 6 illustrates a computer system upon which an embodiment may be implemented.

For example, FIG. 6 is a block diagram that illustrates a computer system 600 upon which an embodiment of the invention may be implemented. Computer system 600 includes a bus 602 or other communication mechanism for communicating information, and one or more hardware processors 604 coupled with bus 602 for processing information, such as basic computer instructions and data. Hardware processor/s 604 may include, for example, one or more general-purpose microprocessors, graphical processing units (GPUs), coprocessors, central processing units (CPUs), and/or other hardware processing units.

Computer system 600 also includes one or more units of main memory 606 coupled to bus 602, such as random access memory (RAM) or other dynamic storage, for storing information and instructions to be executed by processor/s 604. Main memory 606 may also be used for storing temporary variables or other intermediate information during execution of instructions to be executed by processor/s 604. Such instructions, when stored in non-transitory storage media accessible to processor/s 604, turn computer system 600 into a special-purpose machine that is customized to perform the operations specified in the instructions. In some embodiments, main memory 606 may include dynamic random-access memory (DRAM) (including but not limited to double data rate synchronous dynamic random-access memory (DDR SDRAM), thyristor random-access memory (T-RAM), zero-capacitor (Z-RAM™)) and/or non-volatile random-access memory (NVRAM).

Computer system 600 may further include one or more units of read-only memory (ROM) 608 or other static storage coupled to bus 602 for storing information and instructions for processor/s 604 that are either always static or static in normal operation but reprogrammable. For example, ROM 608 may store firmware for computer system 600. ROM 608 may include mask ROM (MROM) or other hard-wired ROM storing purely static information, programmable read-only memory (PROM), erasable programmable read-only memory (EPROM), electrically-erasable programmable read-only memory (EEPROM), another hardware memory chip or cartridge, or any other read-only memory unit.

One or more storage devices 610, such as a magnetic disk or optical disk, is provided and coupled to bus 602 for storing information and/or instructions. Storage device/s 610 may include non-volatile storage media such as, for example, read-only memory, optical disks (such as but not limited to compact discs (CDs), digital video discs (DVDs), Blu-ray discs (BDs)), magnetic disks, other magnetic media such as floppy disks and magnetic tape, solid state drives, flash memory, optical disks, one or more forms of non-volatile random access-memory (NVRAM), and/or other non-volatile storage media.

Computer system 600 may be coupled via bus 602 to one or more input/output (I/O) devices 612. For example, I/O device/s 612 may include one or more displays for displaying information to a computer user, such as a cathode ray tube (CRT) display, a Liquid Crystal Display (LCD) display, a Light-Emitting Diode (LED) display, a projector, and/or any other type of display.

I/O device/s 612 may also include one or more input devices, such as an alphanumeric keyboard and/or any other key pad device. The one or more input devices may also include one or more cursor control devices, such as a mouse, a trackball, a touch input device, or cursor direction keys for communicating direction information and command selections to processor 604 and for controlling cursor movement on another I/O device (e.g. a display). This input device typically has at degrees of freedom in two or more axes, (e.g. a first axis x, a second axis y, and optionally one or more additional axes z . . . ), that allows the device to specify positions in a plane. In some embodiments, the one or more I/O device/s 612 may include a device with combined I/O functionality, such as a touch-enabled display.

Other I/O device/s 612 may include a fingerprint reader, a scanner, an infrared (IR) device, an imaging device such as a camera or video recording device, a microphone, a speaker, an ambient light sensor, a pressure sensor, an accelerometer, a gyroscope, a magnetometer, another motion sensor, or any other device that can communicate signals, commands, and/or other information with processor/s 604 over bus 602.

Computer system 600 may implement the techniques described herein using customized hard-wired logic, one or more ASICs or FPGAs, firmware or program logic which, in combination with the computer system causes or programs, causes computer system 600 to be a special-purpose machine. According to some embodiments, the techniques herein are performed by computer system 600 in response to processor/s 604 executing one or more sequences of one or more instructions contained in main memory 606. Such instructions may be read into main memory 606 from another storage medium, such as one or more storage device/s 610. Execution of the sequences of instructions contained in main memory 606 causes processor/s 604 to perform the process steps described herein. In alternative embodiments, hard-wired circuitry may be used in place of or in combination with software instructions.

Computer system 600 also includes one or more communication interfaces 618 coupled to bus 602. Communication interface/s 618 provide two-way data communication over one or more physical or wireless network links 620 that are connected to a local network 622 and/or a wide area network (WAN), such as the Internet. For example, communication interface/s 618 may include an integrated services digital network (ISDN) card, cable modem, satellite modem, or a modem to provide a data communication connection to a corresponding type of telephone line. Alternatively and/or in addition, communication interface/s 618 may include one or more of: a local area network (LAN) device that provides a data communication connection to a compatible local network 622; a wireless local area network (WLAN) device that sends and receives wireless signals (such as electrical signals, electromagnetic signals, optical signals or other wireless signals representing various types of information) to a compatible LAN; a wireless wide area network (WWAN) device that sends and receives such signals over a cellular network access a wide area network (WAN, such as the Internet 628); and other networking devices that establish a communication channel between computer system 600 and one or more LANs 622 and/or WANs.

Network link/s 620 typically provides data communication through one or more networks to other data devices. For example, network link/s 620 may provide a connection through one or more local area networks 622 (LANs) to one or more host computers 624 or to data equipment operated by an Internet Service Provider (ISP) 626. ISP 626 in turn provides connectivity to one or more wide area networks 628, such as the Internet. LAN/s 622 and WAN/s 628 both use electrical, electromagnetic or optical signals that carry digital data streams. The signals through the various networks and the signals on network link/s 620 and through communication interface/s 618 are example forms of transmission media, or transitory media.

The term "storage media" as used herein refers to any non-transitory media that stores data and/or instructions that cause a machine to operate in a specific fashion. Such storage media may include volatile and/or non-volatile media. Storage media is distinct from but may be used in conjunction with transmission media. Transmission media participates in transferring information between storage media. For example, transmission media includes coaxial cables, copper wire and fiber optics, including traces and/or other physical electrically conductive components that comprise bus 602. Transmission media can also take the form of acoustic or light waves, such as those generated during radio-wave and infra-red data communications.

Various forms of media may be involved in carrying one or more sequences of one or more instructions to processor 604 for execution. For example, the instructions may initially be carried on a magnetic disk or solid state drive of a remote computer. The remote computer can load the instructions into its main memory 606 and send the instructions over a telecommunications line using a modem. A modem local to computer system 600 can receive the data on the telephone line and use an infra-red transmitter to convert the data to an infra-red signal. An infra-red detector can receive the data carried in the infra-red signal and appropriate circuitry can place the data on bus 602. Bus 602 carries the data to main memory 606, from which processor 604 retrieves and executes the instructions. The instructions received by main memory 606 may optionally be stored on storage device 610 either before or after execution by processor 604.

Computer system 600 can send messages and receive data, including program code, through the network(s), network link 620 and communication interface 618. In the Internet example, one or more servers 630 might transmit signals corresponding to data or instructions requested for an application program executed by the computer system 600 through the Internet 628, ISP 626, local network 622 and a communication interface 618. The received signals may include instructions and/or information for execution and/or processing by processor/s 604. Processor/s 604 may execute and/or process the instructions and/or information upon receiving the signals by accessing main memory 606, or at a later time by storing them and then accessing them from storage device/s 610.

Other Aspects Of Disclosure

In the foregoing specification, embodiments of the invention have been described with reference to numerous specific details that may vary from implementation to implementation. The specification and drawings are, accordingly, to be regarded in an illustrative rather than a restrictive sense. The sole and exclusive indicator of the scope of the invention, and what is intended by the applicants to be the scope of the invention, is the literal and equivalent scope of the set of claims that issue from this application, in the specific form in which such claims issue, including any subsequent correction.

What is claimed is:

1. An unmanned surface vehicle comprising:

a vehicle body;

a rigid wing fixedly coupled with the vehicle body such that the rigid wing does not rotationally move with respect to the vehicle body, the rigid wing comprising:

a first surface positioned to face a rear end of the vehicle body, the first surface configured to interact with wind to generate a force that propels the vehicle body that is primarily composed of drag, and a second surface positioned to face a front end of the vehicle body, the second surface configured to interact with wind to generate a force that propels the vehicle body that is primarily composed of lift;

a rudder;

a control system comprising a controller, the control system configured to determine a rudder position and generate a signal to position the rudder to the rudder position.

2. The unmanned surface vehicle of claim 1, wherein, in a first rudder position that directs the unmanned surface vehicle in a downwind direction, the force generated on the rigid wing is primarily a drag component generated by the interaction of apparent wind with the first surface;

wherein, in a second rudder position that directs the unmanned surface vehicle in a perpendicular direction with respect to apparent wind, the force generated on the rigid wing is primarily a lift component generated by the interaction of apparent wind with the second surface.

3. The unmanned surface vehicle of claim 1, wherein the rigid wing is fixedly coupled with the vehicle body with the first surface facing the front end of the vehicle body about perpendicular to a primary axis of the vehicle body and the second surface facing the front end of the vehicle body about perpendicular to the primary axis of the vehicle body.

4. The unmanned surface vehicle of claim 1, wherein the rigid wing is substantially symmetric with respect to starboard tack and port tack.

5. The unmanned surface vehicle of claim 1, further comprising a mast, wherein the vehicle body is fixedly coupled to a first end of the mast, wherein the rigid wing is coupled to the mast.

6. The unmanned surface vehicle of claim 5, wherein the first end of the mast is reinforced.

7. The unmanned surface vehicle of claim 1, further comprising a water generator coupled to the vehicle body, the water generator configured to generate energy when the unmanned surface vehicle travels forward.

8. The unmanned surface vehicle of claim 7, wherein the energy generated by the water generator powers one or more systems of the unmanned surface vehicle during extended periods of darkness.

9. The unmanned surface vehicle of claim 1, further comprising one or more solar panels coupled with the rigid wing.

10. The unmanned surface vehicle of claim 1, wherein the windward surface is flat.

11. The unmanned surface vehicle of claim 1, wherein the windward surface is concave.

12. The unmanned surface vehicle of claim 1, further comprising a keel coupled with the vehicle body at a first end of the keel, wherein the keel comprises ballast sufficient to provide a positive righting moment sufficient to cause the vehicle body to passively right from any position.

13. The unmanned surface vehicle of claim 1, wherein the rigid wing comprises at least one positively buoyant sealed compartment, wherein the sealed compartment provides a positive righting moment when the rigid wing is submerged.

14. The unmanned surface vehicle of claim 1, further comprising a wireless communication device comprising an antenna, wherein the controller is further configured to obtain the at least one waypoint location from the wireless communication device.

15. The unmanned surface vehicle of claim 12, wherein the wireless communication device is further configured to transmit data generated by the controller based on at least one device coupled with the controller.

16. The unmanned surface vehicle of claim 1, wherein the controller is further configured to periodically determine an updated rudder position and generate a signal to position the rudder to the updated rudder position.

17. The unmanned surface vehicle of claim 1, wherein the vehicle body comprises a narrow front end with reduced buoyancy.

18. The unmanned surface vehicle of claim 1, further comprising at least one power source coupled with the control system, wherein the at least one power source comprises at least one battery.

* * * * *